United States Patent [19]

Rubin

[11] 4,445,233

[45] May 1, 1984

[54] HOSIERY WITH INCLUDED POCKET

[76] Inventor: Robert Rubin, 39-24 213rd St., Bayside, N.Y. 11361

[21] Appl. No.: 524,925

[22] Filed: Aug. 19, 1983

[51] Int. Cl.[3] ..... A41B 11/00

[52] U.S. Cl. ..... 2/239; 2/247

[58] Field of Search ..... 2/239, 247, 248, 250

[56] References Cited

U.S. PATENT DOCUMENTS

| | | |
|---|---|---|
| 767,381 | 8/1904 | Brown . |
| 1,128,941 | 2/1915 | Brown . |
| 1,238,196 | 8/1917 | Roedelheim . |
| 2,039,197 | 4/1936 | Strieby . |
| 2,814,807 | 12/1957 | Dollar . |
| 2,890,461 | 6/1959 | Hartman et al. . |
| 3,189,073 | 6/1965 | Todd . |
| 3,368,811 | 2/1968 | Finney . |
| 4,038,699 | 8/1977 | Burn . |

FOREIGN PATENT DOCUMENTS

| | | | |
|---|---|---|---|
| 2743741 | 3/1978 | Fed. Rep. of Germany | 2/239 |
| 2363292 | 9/1976 | France . | |

*Primary Examiner*—Doris L. Troutman

*Attorney, Agent, or Firm*—Ostrolenk, Faber, Gerb & Soffen

[57] ABSTRACT

A sock having a pocket supported inside its leg portion. A first vertical slit opening in the sock provides access to the pocket within the sock and that opening is closed by a zipper. The pocket has a corresponding slit opening in one wall and the margins of the slit opening in the pocket are stitched along the margins of the two tracks of the zipper closure at the opposite sides of the slit opening in the sock. That is the only securement of the pocket to the sock, avoiding additional stitching or fastening of the pocket to the leg portion of the sock. The pocket is large enough and wide enough to hold needed objects.

10 Claims, 5 Drawing Figures

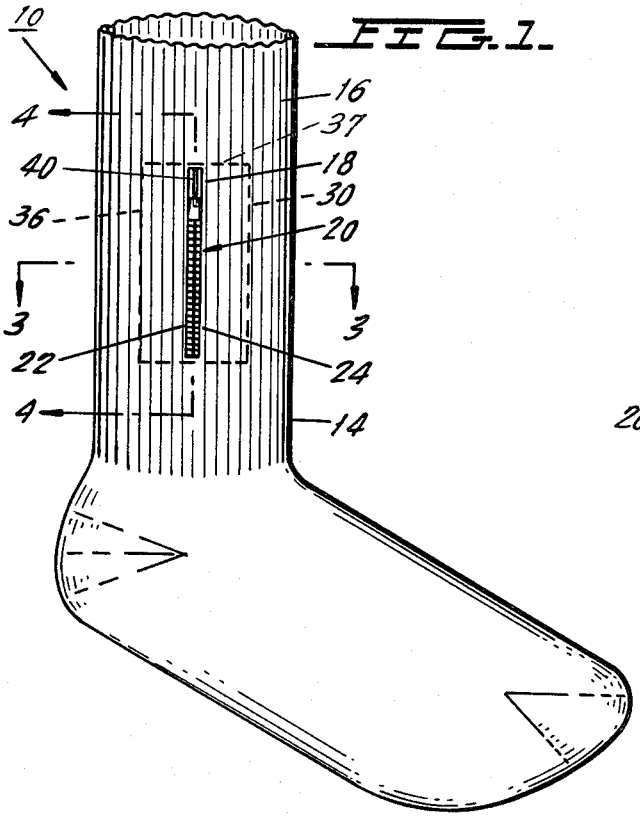
FIG. 1.
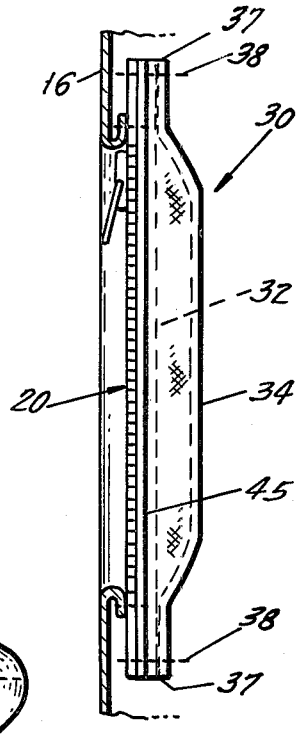
FIG. 4.
FIG. 2.
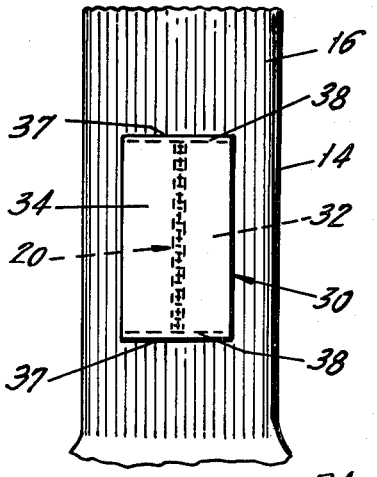
FIG. 5.
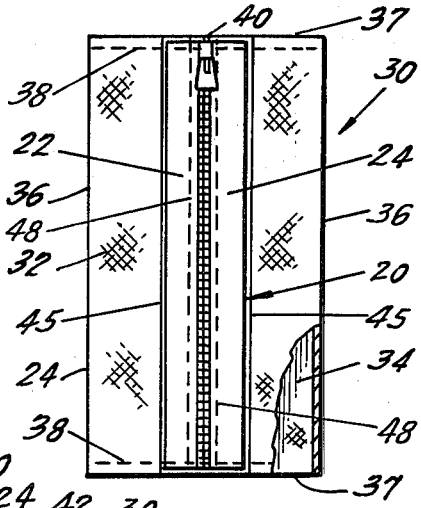
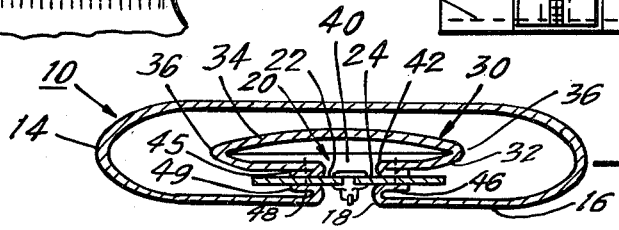
FIG. 3.

HOSIERY WITH INCLUDED POCKET

BACKGROUND OF THE INVENTION

The present invention relates to hosiery with an included pocket and having a closure.

Provision of object holding pockets in hosiery and socks is well known, as evidenced by U.S. Pat. Nos. 2,039,197; 1,238,196; 2,890,461; 2,814,807; 4,038,699, 797,381; and 1,128,941. See also U.S. Pat. No. 3,189,073. Frequently, the pocket is either formed with or stitched inside the hosiery or sock. There is an opening, in the form of a slit, for example, in the sock which communicates into the pocket, and the opening is closed by an appropriate closure, such as laces, a zipper, a snap fastening, etc.

Hosiery typically is of stretchable material. When a pocket is attached inside a sock, it is often stitched to the sock around at least some margins of the pocket. This may be esthetically displeasing. Also, the stitching of the substantially less stretchable pocket to the stretchable sock may interfere with the normal stretching of the sock in the vicinity of the pocket which occurs during wearing, and may perhaps lead to tearing of the sock at the stitching, tearing of the pocket or deforming of the stretched sock in the vicinity of the stitching.

The knitted sock and pocket shown in U.S. Pat. Nos. 4,038,699 has its pocket secured at one end. However, the opening in the sock and the opening in the pocket are not oriented to overlie each other and the side margins of the openings are not secured together.

SUMMARY OF THE INVENTION

It is the primary object of the present invention to provide a pocket inside hosiery or a sock.

It is another object of the invention to provide such a pocket which is large enough to hold sizable objects.

It is yet another object of the invention to affix the pocket to the hosiery without the attachment of the pocket being esthetically displeasing or interfering with stretching of the hosiery as it is worn or weakening the hosiery at the fastening.

According to the present invention, hosiery or a sock adapted with the present invention includes a foot portion for covering the foot and a tubular leg portion for covering at least part of the leg. For providing entrance into a pocket on the leg portion of the hosiery, a first slit opening is formed in the leg portion and the opening typically extends vertically along the leg portion. Closure means, such as a zipper, Velcro fastening, laces, snaps, etc. are attached at the opposite sides of the first slit opening in the hosiery for releasably securing its sides together.

The pocket for being attached in the hosiery is a flexible pocket enclosure to be located inside the leg portion of the hosiery. The pocket enclosure is considerably wider than the closed first slit opening, and is wide enough to carry the usual materials which might be carried in hosiery, including credit cards, cash, keys, etc. If the invention is used on athletic socks, the pocket may be large enough and strong enough to carry some of the athletic equipment, such as a small playing ball, etc. The material of the hosiery or sock itself is sufficiently stretchable and flexible that an object in the pocket will bulge the leg portion of the hosiery outwardly without damaging it.

The pocket has a second slit opening through one of its walls defined by respective second opposite sides.

Each of the second opposite sides of the pocket opening are secured to the leg portion generally at the first opposite sides of the first slit opening into the hosiery. Preferably, this is the only securement between the pocket and the hosiery supporting it. When the hoisery is put on and when the pocket is filled, there wil not be unsightly pocket stitching or attachment marks on the hosiery, the stitched area of the pocket and the hosiery will not prevent stretching of the hosiery, and there will not be an area of weakening. Instead, the stitching only at the side margins of the slit opening in the hosiery will remain unstretched, will not be esthetically unpleasant and will provide the benefits of the invention.

BRIEF DESCRIPTION OF THE DRAWINGS

Other objects, features and advantages of the present invention will become apparent from the following description taken in conjunction with the accompanying drawings, in which:

FIG. 1 is a side elevational view of a sock, containing the invention;

FIG. 2 is a view of the sock turned inside out, showing the pocket;

FIG. 3 is a cross-section through the sock along the line 3—3 in FIG. 2;

FIG. 4 is a fragmentary cross-sectional view through the sock along line 4—4 of FIG. 1; and FIG. 5 is an elevational view of the pocket prior to its attachment in the sock.

DESCRIPTION OF A PREFERRED EMBODIMENT

The present invention is described in conjunction with an athlete's sock 10, although the invention is adaptable for use with any hosiery. The sock 10 has a foot portion 12 which covers the foot of the wearer and a leg portion 14 which extends up the leg to and partially over the calf. At least the leg portion of the sock, and likely the foot portion as well, is a knitted or woven material using at least some stretchable fiber, so that the sock 10 will comfortably and securely engage the leg of the wearer and not roll or fall down of its own weight or due to the weight of the material in the pocket. Typically, the leg portion is stretchable wider, to receive the leg of the wearer and objects inserted into the pocket, but is not substantially stretchable longer.

On one side 16 of the sock, which would preferably be the side of that sock 10 that would face outwardly when the sock is donned by the wearer, a vertically oriented first slit opening 18 is cut in the material of the sock below the top of the sock and above the foot portion. The vertical orientation is selected because the sock is stretched circumferentially when it is donned, and is usually not stretched vertically. Also, this orientation of the first slit opening will not interfere with operation of the closure means 20 for closing the slit opening 18. The slit opening 18 is closed by closure means 20, illustrated as a zipper. The zipper has two sides or tracks 22 and 24 which are hooked together as the zipper handle is pulled up and down, as is conventional. When open, the first slit opening 18 provides access to the interior of the sock.

Inside the leg portion 14 of the sock is disposed the flexible pouch enclosure pocket 30 which comprises a first outward or sock facing wall 32, an opposite inward or leg facing wall 34 and connecting flexible marginal walls 36, 37 around the pocket. The material of the pocket may be nonstretchable or stretchable, as the designer desires. It may be of the same or quite different material than the remainder of the sock. However, the pocket is flexible, so that it can accommodate differently dimensioned objects from a flat credit card or currency to a round ball, keys, etc. Also, the fabric of which the pocket is comprised would be strong enough to hold the objects it is intended to contain through the rough, repeated use to which the sock is normally subjected.

The material and shape of the pocket 30 are selected so that the pocket will retain it shape and not completely collapse or invert, so that objects can be stored in the pocket. The top and bottom peripheral walls 37 of the pocket have respective lines of stitching 38 along them, which would tend to stiffen those walls and also stiffen the main walls 32 and 34 for retaining the shape of the pocket.

In the outward wall 32 of the sock, a vertical second slit opening 40 is cut which is aligned with and is the same length as the slit opening 18 in the side of the sock. The second slit opening 40 is defined by its own opposite edge margins 42, 44 which are folded out at the flaps 45 to open the opening 40. The flaps 45 are stitched at 46, 48 to the respective outer edges 49 of the two tracks of the zipper 20. There need be no further fastening between the pocket and the sock for holding the pocket in position. The first slip opening 18 in the sock will open and close at the same time as the second slit opening 40 in the pocket, and the zipper 20 will open and close both openings. As the pocket 30 is not attached to the sock at any other location besides the slit openings 18, 40, the drawbacks of prior art, discussed above, do not occur with the present invention.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. Hosiery with included pocket, comprising:

a hosiery piece including a foot portion and a tubular leg portion for covering at least part of the leg of a wearer;

a slit opening formed in the leg portion extending a first length therealong; the slit opening having first opposite sides, and closure means for selectively opening and closing the slit opening by respectively securing the first sides together and by releasing that securement;

a flexible pocket enclosure inside the leg portion and having a width greater than the distance between the opposite sides of the slit opening, with the closure means closing the slit opening;

the pocket being defined by a plurality of walls; an opening through one of the walls of the pocket; the pocket opening also being defined by second opposite sides thereof in the respective pocket walls; each of the pocket second opening opposite sides being secured to the leg portion generally at a respective one of the first opposite sides of the first opening in the hosiery piece.

2. The hosiery of claim 1, wherein the first slit opening has a direction of extension along the leg portion; the securement of the pocket enclosure generally at the first opposite sides of the first slit opening is the only securement of the pocket enclosure to the leg portion, whereby at and outward of the opposite sides of the first slit opening, the pocket enclosure is not secured to the leg portion.

3. The hosiery of claim 2, wherein the leg portion of the hosiery is of a construction which causes the leg portion to stretch to greater circumference as the leg portion is drawn onto the leg and is worn there.

4. The hosiery of claim 3, wherein the first slit opening extends up and down the leg portion.

5. The hosiery of claim 3, wherein the pocket enclosure comprises a flexible pouch having a flexible, hosiery facing, outward wall facing the interior of the leg portion of the hosiery and through and along which outward wall the second opening is formed; the enclosure having a flexible leg facing inward wall, and the hoisery facing and leg facing walls being secured together at their edge margins for defining the enclosed flexible pouch.

6. The hosiery of claim 5, wherein the securement together of the hosiery facing and leg facing walls of the pouch are peripheral flexible walls, whereby the pouch may stretch larger as the pouch is filled.

7. The hosiery of claim 6, wherein at at least some of the peripheral flexible wall means are provided for stiffening those walls for aiding the pocket in maintaining its shape.

8. The hosiery of claim 2, wherein the closure means comprises a zipper having opposite tracks which are respectively attached at the first opposite sides of the slit opening.

9. The hosiery of claim 2, wherein the hosiery is a sock and the leg portion of the hosiery is generally at the calf of the wearer.

10. The hosiery of claim 1, wherein the pocket enclosure comprises a flexible pouch having a flexible hosiery facing, outward wall facing the interior of the leg portion of the hosiery and through and along which outward wall the second opening is formed; the enclosure having a flexible leg facing inward wall, and the hosiery facing and leg facing walls being secured together at their edge margins for defining the enclosed flexible pouch.

* * * * *